United States Patent [19]

Frigo

[11] 4,045,752

[45] Aug. 30, 1977

[54] COMPACT ELECTROMAGNETIC RELAY, PARTICULARLY FOR AUTOMOTIVE VEHICLES

[75] Inventor: Domenico Frigo, Olmo (Venice), Italy

[73] Assignee: Fabbrica Italiana Accumulatori Motocarri Montecchio S.p.A. - F.I.A.M.M., Montecchio Maggione (Venice), Italy

[21] Appl. No.: 635,635

[22] Filed: Nov. 26, 1975

[30] Foreign Application Priority Data

Jan. 31, 1975 Italy ..... 19827/75

[51] Int. Cl.[2] ..... H01H 9/02

[52] U.S. Cl. ..... 335/202; 335/203

[58] Field of Search ..... 335/81, 82, 127, 131, 335/202, 203

[56] References Cited

U.S. PATENT DOCUMENTS

| | | | |
|---|---|---|---|
| 3,260,818 | 7/1966 | Fisher et al. | 335/82 |
| 3,544,930 | 12/1970 | Sauer | 335/202 X |

*Primary Examiner*—George Harris
*Attorney, Agent, or Firm*—Karl F. Ross

[57] ABSTRACT

An electromagnetic relay comprises a base formed with a depression in which a plate-shaped ferromagnetic armature rests under its own weight in an inclined position with reference to the lower surfaces of the legs of an electromagnetic yoke overlying that depression, these surfaces defining with the armature a pair of air gaps which in the unexcited condition of the relay increase in width from one edge of the armature to the opposite edge. A movable contact member in the form of a flat spring bracketed by the yoke legs, spacedly overlying the armature in this unexcited condition, is clamped to the base at the narrow gap end and has a free extremity, coacting with a fixed contact member, at the wider end; magnetization of the yoke elevates the armature into engagement with the contact spring near its clamped extremity and then causes it to swing into contact with the free spring extremity for closing (or opening) a load circuit which is independent of the energizing circuit of the relay. The base may consist of two complementary sections, clamping the contact members between them, which are held together by a surrounding frame, the assembly being consolidated by a cover embracing the electromagnetic mechanism as well as the composite base itself.

14 Claims, 11 Drawing Figures

COMPACT ELECTROMAGNETIC RELAY, PARTICULARLY FOR AUTOMOTIVE VEHICLES

Field of the Invention

My present invention relates to an electromagnetic relay adapted to be mounted on a movable support, e.g. under the hood of an automotive vehicle.

BACKGROUND OF THE INVENTION

Such a relay should be not only of compact construction but also stable against shocks occurring, for example, upon a sudden stop or acceleration of the vehicle. Since most of these shocks act essentially in a horizontal direction, it is customary to provide such relays with a generally horizontal armature which is vertically movable by the applied magnetic force to close or to open an electrical circuit. The armature is usually a plate hinged at one end to the associated electromagnetic yoke and provided at the opposite end with a movable contact confronting an associated stationary contact coacting therewith; the yoke is supported on a base traversed by leads such as pins or prongs serving to connect the exciting coil or coils of the yoke as well as the relay contacts in an electric circuit including a battery or other power supply. A spring or the like biases the armature away from the yoke to hold the contacts open (or, possibly, closed) in the unexcited state of the relay.

In the presence of strong vertical shocks, however, the armature of such a relay may be accidentally moved into its alternate position with resulting untimely closure or opening of the controlled circuit. Moreover, since the armature and its biasing spring or equivalent elastic means form a resonant system, vibrations of a frequency near the natural frequency of that system may result in a chattering of the contacts in the unexcited state of the relay. An increase in the biasing force to prevent such untimely operation requires, of course, a larger operating current for the energization of the relay coil.

OBJECTS OF THE INVENTION

An important object of my present invention, therefore, is to provide an improved electromagnetic relay which avoids the aforestated drawbacks.

A more particular object is to provide a relay of compact construction which can be conveniently assembled without screws, rivets or thermal fusion.

SUMMARY OF THE INVENTION

In accordance with the present invention, the armature of my improved relay normally rests on the base with freedom of vertical movement, the associated yoke having a pair of generally vertical legs or cheeks which terminate above the armature and form therewith a pair of air gaps. Upon magnetization of the yoke by the energization of its coil or coils, the armature is attracted toward these legs and engages an overlying first contact member — such as a flat steel spring — which is spaced therefrom in a substantially horizontal normal position and is elevated by the rising armature into its alternate position in which it either closes or opens the controlled circuit. For purposes of the following description, it will be assumed that the relay normally opens that circuit, i.e. that its movable contact displaceable by the armature is spaced from the associated stationary contact in the demagnetized state of the yoke, though the invention is of course equally applicable to both make and break contacts.

Thus, the armature of the unexcited relay is not subject to the biasing force action upon the overlying contact member and is therefore not unduly responsive to vibrations of a particular frequency.

I have further found, pursuant to another feature of my invention, that the effect of vertical shocks upon the armature can be mitigated by normally holding same in an inclined position in which the air gaps formed with the legs of the yoke increase from one edge of the armature to its opposite edge, the overlying contact spring having a clamped extremity above the higher edge and a free extremity above the opposite, lower edge whereby the armature, upon magnetization of the yoke, initially comes to bear upon the clamped spring extremity and thereupon swings its opposite edge upwardly into engagement with the free extremity for displacing same. Thus the magnetic flux is concentrated at first in the region of the higher armature edge and may therefore be generated by a relatively low current to close the relay contacts even if the weight of the armature and/or its normal distance from the yoke is large enough to guard against untimely operation in response to road shocks or the like.

In accordance with a particularly advantageous embodiment of my invention, the base of the relay comprises two complementary sections which bracket the contact members therebetween and are locked together by a surrounding frame, the assembly being maintained by a box-shaped cover which bears from above upon the frame and terminates in bottom lugs bent around the underside of the base. The two complementary sections, which I prefer to equip with interfitting formations such as pins and bores, have peripheral rabbets supporting the frame from below while the cover bears down upon it from above; the frame may also have cam portions which are snap-fitted into undercuts of the two base sections. The entire base may be made of a somewhat resilient insulating (e.g. thermoplastic) material.

BRIEF DESCRIPTION OF THE DRAWING

The above and other features of my invention will now be described in detail with reference to the accompanying drawing in which.

SPECIFIC DESCRIPTION

Figure 1:
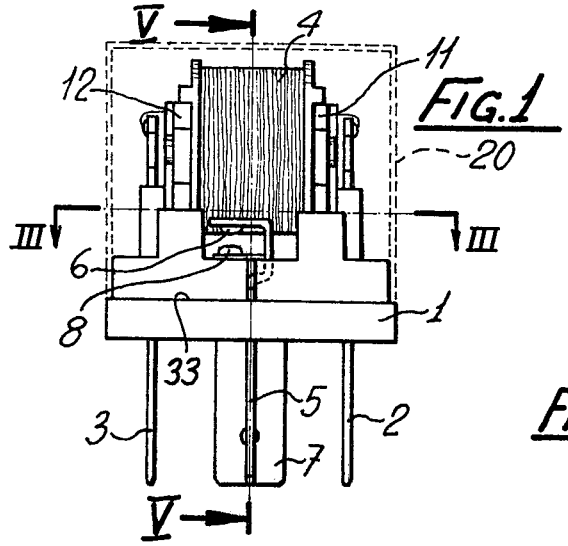
FIG. 1 is a front-elevational view of a relay embodying my invention.
Figure 2:
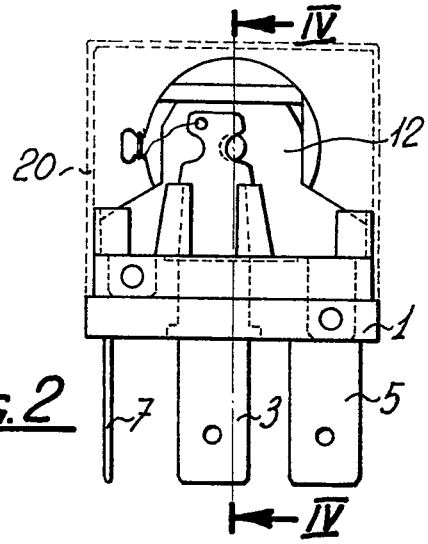
FIG. 2 is a side-elevational view of the relay shown in FIG. 1.
Figure 4:
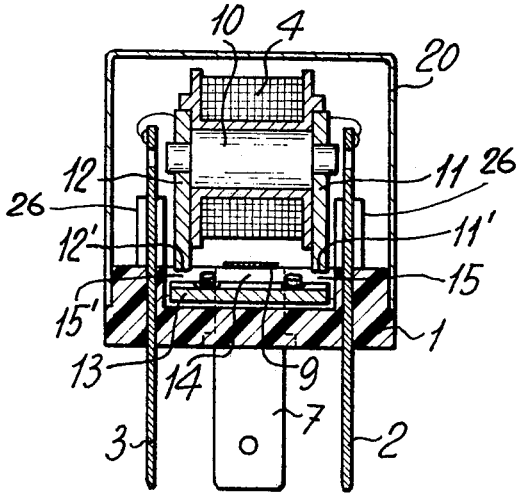
FIGS. 4 and 5 are sectional views respectively taken on the line IV — IV of FIG. 2 and on the line V — V of FIG. 1.
Figure 5:
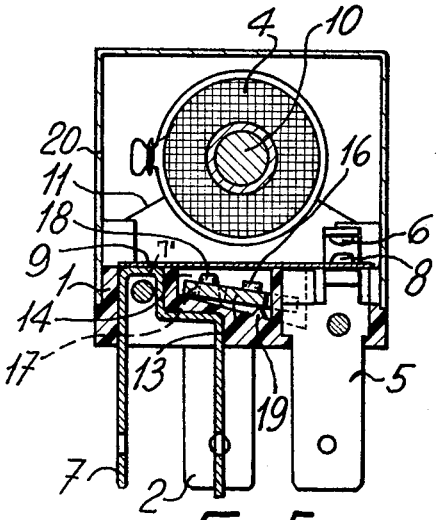
Figure 3:
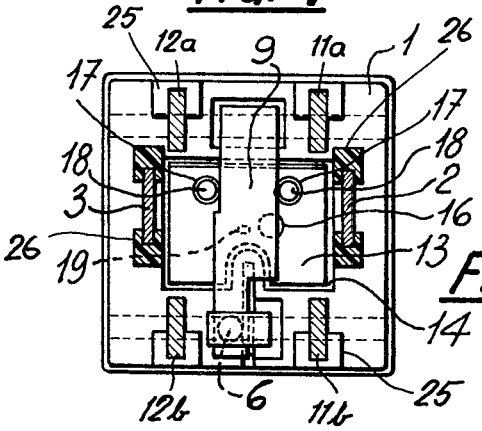
FIG. 3 is a cross-sectional view taken on the line III — III of FIG. 1.
Figure 6:
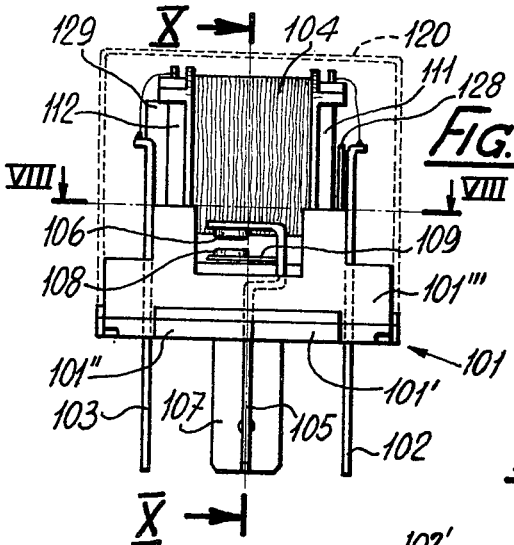
FIG. 6 is a view similar to FIG. 1 of another relay according to my invention.
Figure 7:
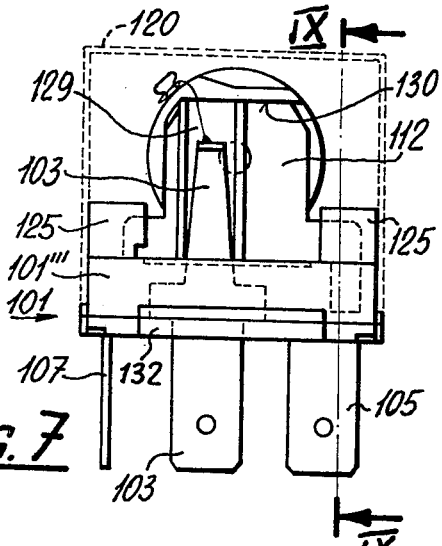
FIG. 7 is a view similar to FIG. 2 of the relay shown in FIG. 6.

In FIGS. 1 – 5 I have shown a relay with an insulating base 1 traversed by a series of upstanding leads in the form of flat strips or prongs, specifically two leads 2, 3 included in the energizing circuit of an electromagnetic coil 4, a lead 5 forming part of a fixed contact member with a bump 6, and a clip 7 of inverted-U shape whose bight portion has a sill 7′ soldered or welded onto one end of a flat horizontal spring 9 whose free opposite end bears a bump 8 confronting the bump 6; the clip 7 and the spring 9 constitute a movable contact member coacting with fixed member 5. Through its soldered connection with clip 7 the spring 9 is clamped in the base 1 at its extremity remote from bump 8. The two arms of clip 7 may be connected to the same terminal of the nonillustrated power supply, preferably ground, yet one of these arms (e.g. the inner one) may be cut off below the base if only a single terminal lead is desired.

Coil 4 surrounds a ferromagnetic core 10 forming part of an electromagnetic yoke whose legs are constituted by a pair of cheek plates 11 and 12 with holes traversed by the reduced ends of the core. The cheek plates have lateral wings 11*a*, 11*b*, 12*a*, 12*b* received in vertically channeled cuffs 25 on the edges of base 1; their central portions extend across a depression or cavity 14 of base 1 provided with an inclined bottom. A mgnetically permeable armature 13 in the form of a flat plate rests under its own weight on the bottom of depression 14 in the unexcited state of coil 4, this armature being spacedly overlain by the contact spring 9 and sloping downwardly from the vicinity of the clamped end of that spring (left in FIG. 5) toward its free end (right). Since the bottom edges 11′ and 12′ of yoke legs 11 and 12 lie approximately at the level of spring 9, they define with the sloping armature 13 a pair of air gaps 15 and 15′ whose width increases from left to right as viewed in FIG. 5. Thus, the air gaps are narrowest at the raised left-hand edge of armature 13 and widest at the lower right-hand edge thereof. Near that elevated edge the armature 13 is formed with a pair of guide hole 17 traversed by studs 18 which rise from the bottom of depression 14; a boss 19 near the opposite edge of the armature holds the latter slightly spaced from that bottom to prevent a possible adhesion due to a film of water or oil forming on their confronting surfaces. For the same reason the upper surface of armature 13 carries a boss 16 designed to hold it spaced from the overlying spring 9 when the armature is attracted upwardly upon the energization of coil 4. Naturally, the bosses 16 and 19 could also be provided on the undersides of spring 9 and armature 13, respectively.

Prongs 2, 3 are shown bracketed by channeled uprights 26 rising integrally from base 1.

If an operating current passes through the coil 4, yoke 10 – 12 is magnetized and initially attracts the left-hand edge (FIG. 5) of armature 13 at the narrow end of air gaps 15 and 15′, the armature thereupon comting to bear with that left-hand edge upon the underside of overlying spring 9. The inherent biasing force of that spring, however, keeps the contact points 6 and 8 spaced apart until air gaps 15 and 15′ are further reduced by the force now exerted upon the remainder of the armature which therefore pivots counterclockwise about its left-hand edge and until the boss 16 engages the spring 9, thereby lifting the free end of the latter off its seat on base 1 and causing closure of contact points 6, 8. It will be apparent that even severe vertical shocks will not exert upon armature 13 a sufficient force to produce this composite motion.

The energizing circuit for coil 104 is completely divorced from the load circuit including contact members 5 and 7 whereby practically the entire supply voltage is available at the load terminals. In the unoperated state of the relay, only one of the contacts (e.g. member 5) will have voltage applied to it.

A box-shaped cover 20 fits from above around the electromagnetic assembly supported by base 1 and rests on a peripheral rabbet 33 of the base.

The construction of the relay in FIGS. 6 – 11 is generally similar to that of the embodiment of FIGS. 1 – 5 and corresponding reference numerals, increased by 100, have been used to designate analogous elements. Thus, leads 102 and 103 are connected across a coil 104 whose core 110 forms a yoke with a pair of cheek plates 111 and 112, these leads traversing a base 101 together with contact members 105 and 107, 109 bearing confronting bumps 106 and 108. A sloping armature 113 rests under its own weight on the bottom of a depression 114 in base 101 from which it is kept spaced by bosses 119 and 119′, the armature being held against horizontal shifting by guide studs 118 passing through holes 117. A bulge 116 near the lower edge of armature 113 maintains a certain clearance between the armature and the overlying spring 109. Upon energization of coil 104, the armature swings counterclockwise about a fulcrum formed by the line of contact between its left-hand edge (FIG. 10) and spring 109. Thus, the mode of operation of this relay is the same as with the first embodiment.

Figure 9:
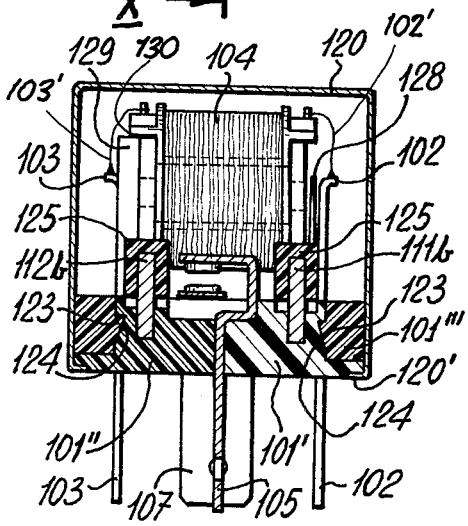
FIGS. 9 and 10 are sectional views respectively taken on the line IX — IX of FIG. 7 and on the line X — X of FIG. 6.
Figure 10:
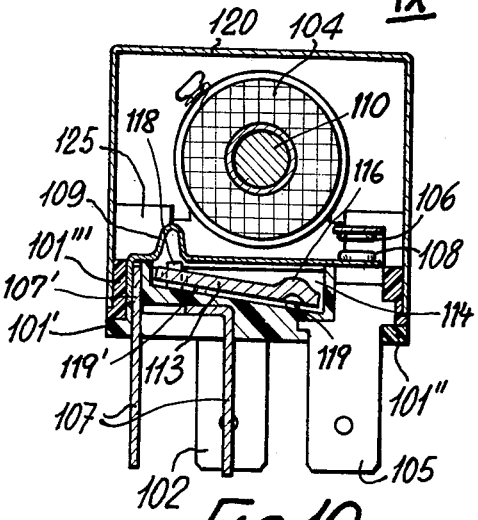
Figure 8:
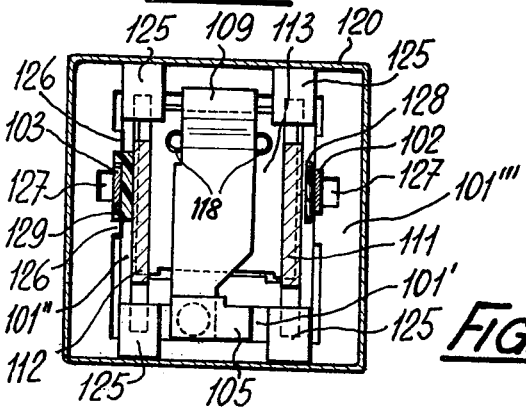
FIG. 8 is a cross-sectional view taken on the line VIII — VIII of FIG. 6.
Figure 11:
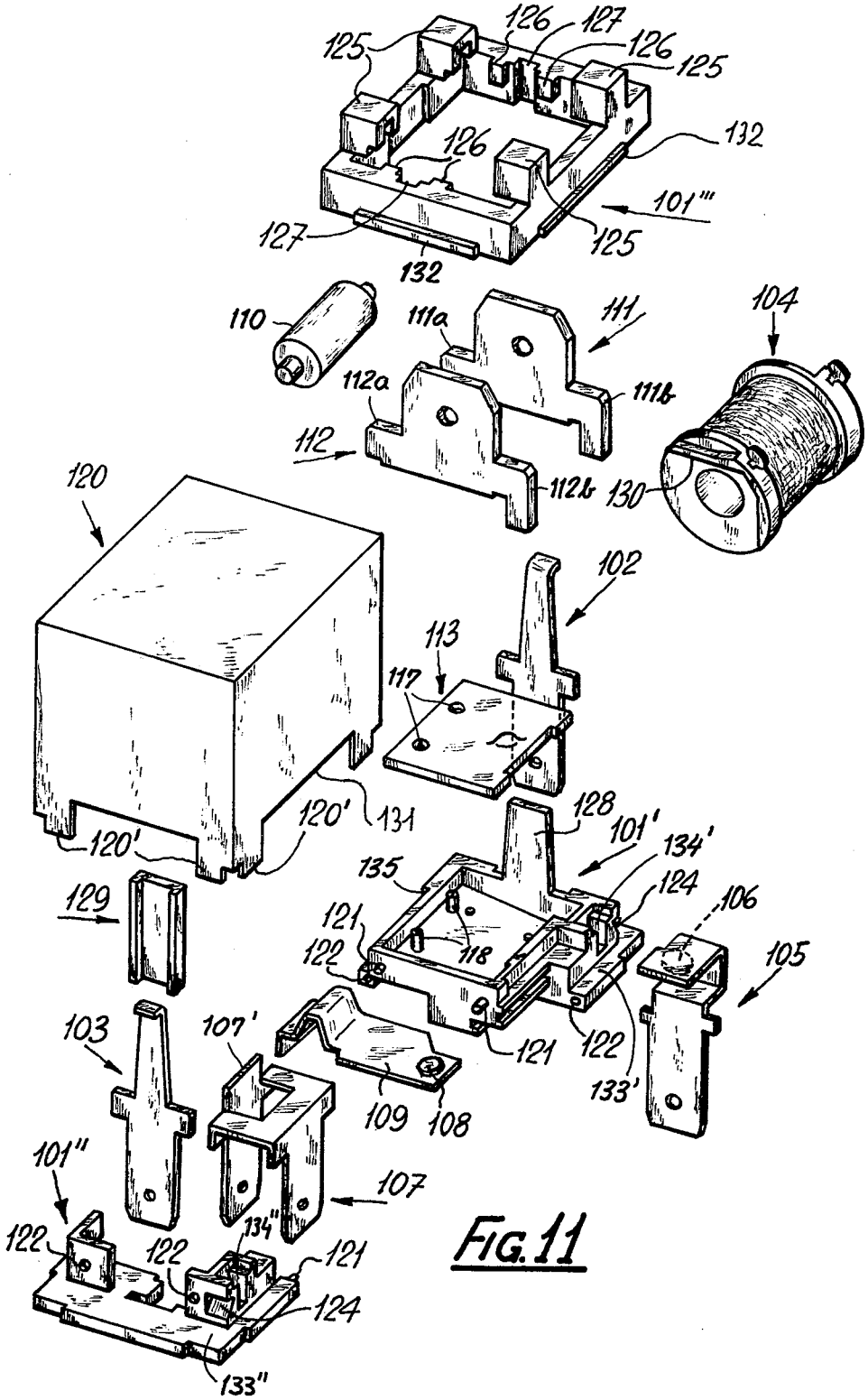
FIG. 11 is an exploded isometric view of the relay shown in FIGS. 6 — 10.

Base 101 is divided into three components, namely two horizontally adjoining complementary sections 101′, 101″ and a surrounding frame 101‴ supported by peripheral rabbets 133′, 133″ of these sections. Cover 120 fits around the entire composite base and is provided with corner lugs 120′ which in the assembled state are bent over (see FIG. 9) to grip the undersides of sections 101′ and 101″ even as the frame 101‴ is held down by recessed edges 131 of that cover bearing from above upon ledges 132 on the outer frame periphery. Pins 121 and bores 122 on the two complementary base sections 101′, 101″ interfit to locate them in their correct relative position. Frame 101‴ is provided along its inner periphery with cam portions 123 which snap into undercuts 124 of sections 101′, 101″ as seen in FIG. 9.

The terminal clip 107 of the movable contact member, whose sill 107′ consists of an upward extension of the outer clip arm, is again soldered to the contact spring 109 which is thereby clamped at its left-hand end (FIG. 10) to the base section 101′ formed with the depression or cavity 114. Wings 111*a*, 112*a* of cheek plates 111, 112 rest on the upper surface of section 101′ whereas wings 111*b*, 112*b* have depending spurs received in sockets 134′ and 134″ of sections 101′ and 101″, respectively. These wings are also bracketed from above by channeled cuffs 125 on frame 101″ overhanging the base sections 101′ and 101″.

Prongs 102 and 103, from whose bent-over tips a pair of wires 102′ and 103′ extend to the terminals of coil 104, are accommodated between shoulders 126 of frame Φ‴ flanking a pair of notches 127 which give passage to these tips when the prongs are introduced from below into the spaced enclosed by cover 120. Prong 102 is electrically shielded from the adjoining cheeck plate 111 by a tongue 128 rising integrally from base section 101′. A similar shield for prong 103, separating it from cheek plate 112, comprises a strip 129 with raised edges which is clipped onto that prong after assembly. Shield 129 is held down by a shield 130 on the adjoining end face of coil 104.

In assembling the relay shown in FIGS. 6 -11, I first insert the sill 107' of clip 107 into a slot of base section 101' bounded by a shoulder 135, this sill being already soldered to the spring 109 which thus comes to rest above the armature 113 received in depression 114. Sections 101', 101'' of base 101 are then joined together whereupon the cheek plates 111 and 112, already secured to the core 110 of coil 104, are emplaced on the base from above whereas prongs 102 and 103 are inserted from below. After the shield 129 has been clipped to prong 103 and snapped under the shelf 130, the wires 102' and 103' are soldered to prongs 102 and 103. With contact member 105 gripped between sections 101' and 101'', the electrical connections are all completed. Next, the frame 101''' is slid down around the base sections 101', 101'' onto their rabbets 133', 133'' until its cam portions 123 snap into the undercuts 124 at which point the walls of the frame press firmly against the prongs 102 and 103 to hold them in place. The yoke 110-112 with its coil 104 is locked in position by the cuffs 125 of frame 101'''. Finally, the cover 120 is lowered onto the base and secured thereto by an inbending of its corner lugs 120'.

I claim:

1. An electromagnetic relay comprising:

a base;

an electromagnetic yoke mounted on said base;

an armature underneath said yoke normally resting on said base with freedom of vertical movement, said yoke having a pair of generally vertical legs terminating above said armature and forming therewith a pair of air gaps;

coil means on said yoke for magnetizing same to attract said armature toward said legs;

a first contact member of said base spacedly overlying said armature in the de-energized state of said yoke; and a second contact member on said base coacting with said first contact member, said first contact member being biased into a substantially horizontal normal position and being engageable by said armature of elevation into an alternate position relative to said second contact member upon energization of said yoke.

2. A relay as defined in claim 1 wherein said base is provided with a depression accommodating said armature, said legs overlying said depression.

3. A relay as defined in claim 2 wherein said recess has a bottom supporting said armature in a sloping position with said air gaps increasing from one edge of said armature to an opposite edge thereof, said first contact member comprising a flat spring lying between said legs with a clamped extremity above said one edge and with a free extremity extending beyond said edge whereby said armature upon magnetization of said yoke comes to bear initially upon said clamped extremity with said one edge and thereupon swings said opposite edge upwardly into engagement with said free extremity for displacing same.

4. A relay as defined in claim 3 wherein confronting surfaces of said armature and of said spring are separated from each other by a projection on one of said surfaces in the attracted position of said armature.

5. A relay as defined in claim 3, further comprising spacing means keeping at least said opposite edge of said armature separated from said bottom in the normal position of said armature.

6. A relay as defined in claim 3 wherein said armature is provided with an aperture adjacent said one edge, said base being provided with a guide stud rising from said bottom and traversing said aperture.

7. A relay as defined in claim 1 wherein said coil means is provided with an operating circuit independent of said contact members.

8. A relay as defined in claim 1 wherein said base comprises two complementary sections, bracketing said contact members therebetween, and a locking frame surrounding said sections.

9. A relay as defined in claim 8 wherein said sections are provided with peripheral rabbets, further comprising a box-shaped cover for said base enclosing said base enclosing said yoke, said armature and said contact members while resting on said rabbets, said cover bearing from above upon said frame and being provided with bottom lugs bent around said rabbets for holding said base together.

10. A relay as defined in claim 8 wherein said sections are provided with interfitting formations, said frame having cam portions snap-fitted into undercuts of said sections.

11. A relay as defined in claim 8 wherein said first contact member comprises a terminal clip of inverted-U shape with a sill extending above a bight portion and a flat, substantially horizontal spring fixedly secured to said sill, one of said sections extending between said bight portion and said spring.

12. A relay as defined in claim 8 wherein said yoke comprises a horizontal core above said base, said legs being a pair of pole shoes depending from opposite ends of said core and having lateral wings positively fitted from above into recesses of said sections, said frame being provided with overhanging channeled cuffs engaging said wings from above.

13. A relay as defined in claim 8 wherein said coil means is provided with a pair of connector prongs rising through said base and bracketing said legs between them, further comprising shield means separating said prongs from said legs.

14. A relay as defined in claim 13 wherein said shield means comprise a tongue integral with one of said sections interposed between one of said legs and one of said prongs, and a strip separate from said base clipped onto the other end of said prongs between the latter and the other of said legs.

* * * * *